US009863311B2

(12) United States Patent
Hiyoshi et al.

(10) Patent No.: US 9,863,311 B2
(45) Date of Patent: Jan. 9, 2018

(54) VARIABLE COMPRESSION RATIO INTERNAL COMBUSTION ENGINE

(71) Applicant: Nissan Motor Co., Ltd., Yokohama-shi, Kanagawa (JP)

(72) Inventors: Ryosuke Hiyoshi, Kanagawa (JP); Katsutoshi Nakamura, Kanagawa (JP)

(73) Assignee: Nissan Motor Co., Ltd., Yokohama-Shi, Kanagawa (JP)

( * ) Notice: Subject to any disclaimer, the term of this patent is extended or adjusted under 35 U.S.C. 154(b) by 0 days.

(21) Appl. No.: 15/506,899

(22) PCT Filed: Sep. 2, 2014

(86) PCT No.: PCT/JP2014/072968

§ 371 (c)(1),
(2) Date: Feb. 27, 2017

(87) PCT Pub. No.: WO2016/035127

PCT Pub. Date: Mar. 10, 2016

(65) Prior Publication Data

US 2017/0284289 A1 Oct. 5, 2017

(51) Int. Cl.
*F02B 75/04* (2006.01)
*F02B 75/32* (2006.01)

(52) U.S. Cl.
CPC ..... *F02B 75/04* (2013.01); *F02B 75/32* (2013.01)

(58) Field of Classification Search
CPC ..... F02B 75/04; F02B 75/044; F02B 75/045; F02B 75/047; F02B 75/048; F02B 75/32
See application file for complete search history.

(56) References Cited

U.S. PATENT DOCUMENTS

| | | | | |
|---|---|---|---|---|
| 7,373,915 | B1 * | 5/2008 | Joniec | F02B 75/048 123/197.1 |
| 2007/0169739 | A1 | 7/2007 | Meyer et al. | |
| 2009/0041398 | A1 * | 2/2009 | Tanaka | F02B 75/048 384/429 |
| 2011/0048383 | A1 * | 3/2011 | Pattakos | F02B 75/047 123/48 B |
| 2013/0306035 | A1 | 11/2013 | Hiyoshi et al. | |
| 2013/0327302 | A1 | 12/2013 | Hiyoshi | |

FOREIGN PATENT DOCUMENTS

| | | | |
|---|---|---|---|
| JP | 2003247524 | A | 9/2003 |
| JP | 2003322036 | A | 11/2003 |
| JP | 2011169152 | A | 9/2011 |
| JP | 2013241846 | A | 12/2013 |
| JP | 2013253512 | A | 12/2013 |

* cited by examiner

*Primary Examiner* — Hung Q Nguyen
(74) *Attorney, Agent, or Firm* — Young Basile Hanlon & MacFarlane, P.C.

(57) ABSTRACT

A variable compression ratio internal combustion engine includes: a variable compression ratio mechanism arranged to vary an engine compression ratio in accordance with a rotation position of a first control shaft; an actuator arranged to vary and hold the rotation position of the first control shaft; and a link mechanism arranged to connect the actuator and the first control shaft, the link mechanism including; a second control shaft, a lever, a first arm portion, a first link pin, a second arm portion, and a second link pin, the first link pin having a diameter larger than a diameter of the second link pin.

9 Claims, 5 Drawing Sheets

VARIABLE COMPRESSION RATIO INTERNAL COMBUSTION ENGINE

TECHNICAL FIELD

This invention relates to a variable compression ratio internal combustion engine including a variable compression ratio mechanism arranged to vary an engine compression ratio in accordance with a rotation position of a first control shaft.

BACKGROUND

Japanese Patent Application Publication No. 2013-253512 discloses an internal combustion engine (hereinafter, referred to as "variable compression ratio internal combustion engine) including a variable compression ratio mechanism arranged to vary an engine compression ratio in accordance with a rotation position of a first control shaft. A link mechanism is provided between an actuator such as a motor which is arranged to drive the first control shaft, and the first control shaft. A second control shaft is provided to this link mechanism. The second control shaft is connected through a lever to the first control shaft. The second control shaft is supported within a housing fixed, for example, to an engine main body.

In this variable compression ratio internal combustion engine, the large load in the axis inclining direction is acted to the bearing portion of the first link pin connected to the first arm portion of the first control shaft in which the bending/torsion vibration is generated. Accordingly, the first link pin is strongly contacted at the one end portion of the bearing portion. That is, the load of the partial contact tends to be large. On the other hand, on the second link pin's side, the first link pin and the lever are disposed between the first control shaft and the second link pin. Accordingly, the load is decreased by the clearance of the bearing portion between the first link pin and the lever. The load in the axis inclining direction to the bearing portion is suppressed to the low value relative to the first link pin. Consequently, the local surface pressure acted to the bearing portion is low.

Therefore, when the identical load is acted to the first link pin and the second link pin, the local surface pressure of the first link pin is increased, so that the abrasion is easy to be progressed.

SUMMARY

It is an object of the present invention to solve the above-mentioned problems. That is, a variable compression ratio internal combustion engine according to the present invention comprises: a variable compression ratio mechanism arranged to vary an engine compression ratio in accordance with a rotation position of a first control shaft; an actuator arranged to vary and hold the rotation position of the first control shaft; and a link mechanism arranged to connect the actuator and the first control shaft.

The link mechanism includes; a second control shaft disposed in parallel with the first control shaft, a lever connecting the first control shaft and the second control shaft, a combustion load acted to the first control shaft being transmitted through the lever to the second control shaft, a first arm portion extending from the first control shaft in a radially outward direction, a first link pin which is inserted through a tip end of the first arm portion and one end of the lever, and which connects the first arm portion and the lever so that the first arm portion and the lever are rotated relative to each other, a second arm portion extending from the second control shaft in the radially outward direction, and a second link pin which is inserted through a tip end of the second arm portion and the other end of the lever, and which connects the second arm portion and the lever so that the second arm portion and the lever are rotated relative to each other.

The first link pin has a diameter larger than a diameter of the second link pin.

By the present invention, in the first link pin and the second link pin, the large load in the axis inclining direction is acted to the bearing portion of the first link pin which is near the piston, and to which the combustion load is acted, by the combustion load from the piston's side. However, the diameter of the first link pin is set to a relatively large value. Accordingly, it is possible to suppress the progress of the abrasion. On the other hand, the diameter of the second link pin which is farther from the piston is set to the relatively small value. With this, it is possible to decrease the motion trajectory (locus), and thereby to improve the engine mountability.

DETAILED DESCRIPTION OF THE EMBODIMENTS

Figure 1:
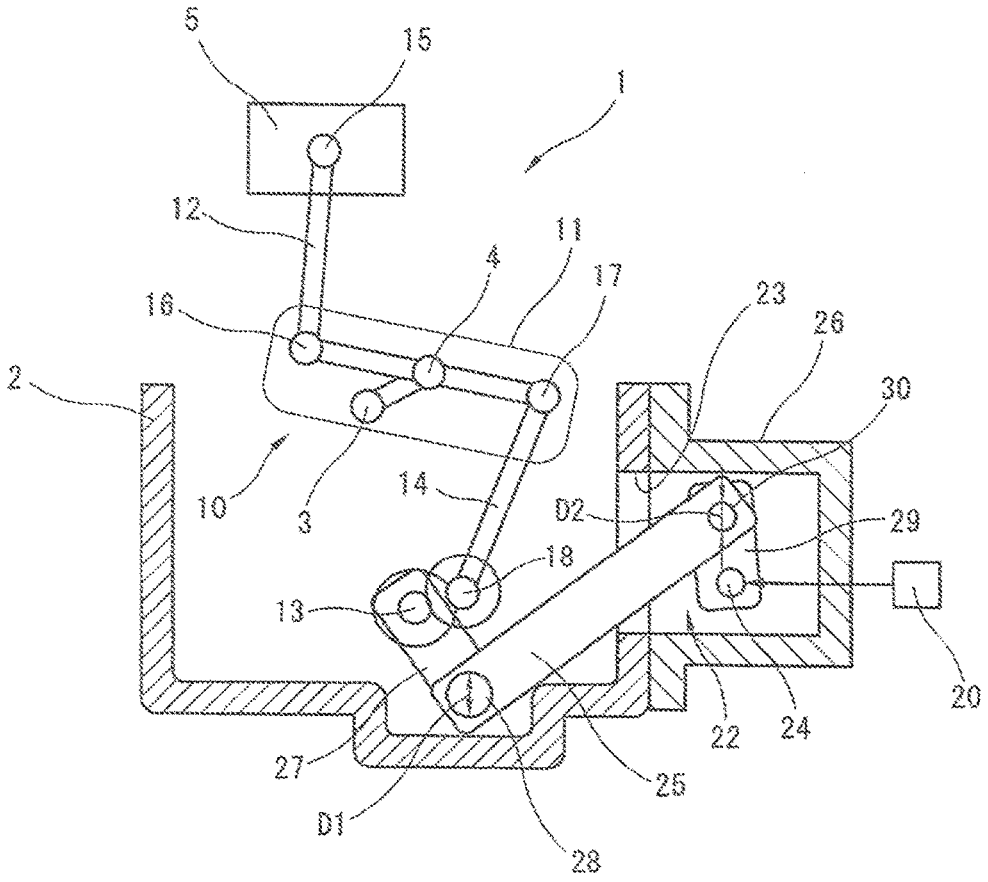
FIG. 1 is a schematic view schematically showing a variable compression ratio internal combustion engine including a variable compression ratio mechanism according to one embodiment of the present invention.

Hereinafter, the present invention is illustrated based on one embodiment shown in the drawings. FIG. 1 is a configuration view schematically showing a variable compression ratio internal combustion engine provided with a variable compression ratio mechanism 10 according to one embodiment of the present invention. A crank shaft 3 is rotatably supported to a cylinder block 2 of this variable compression ratio mechanism internal combustion engine 1.

The variable compression ratio mechanism 10 includes a lower link 11 rotatably mounted to a crank pin 4 of the crank shaft 3; an upper link 12 connecting the lower link 11 and a piston 5; a first control shaft 13 rotatably supported by the cylinder block 2; and a control link 14 connecting this first control shaft 13 and the lower link 11. An upper end of the upper link 12 and the piston 5 are connected by a piston pin 15 to be rotated relative to each other. The upper link 12 and the lower link 11 are connected by an upper pin 16 to be rotated relative to each other. The lower link 11 and an upper end of the control link 14 are connected by a control pin 17 to be rotated relative to each other. A lower end portion of the lower link 11 is rotatably connected to a control eccentric shaft portion 18 provided to be eccentric from a journal portion which is a rotation center of the first control shaft 13.

Figure 2:
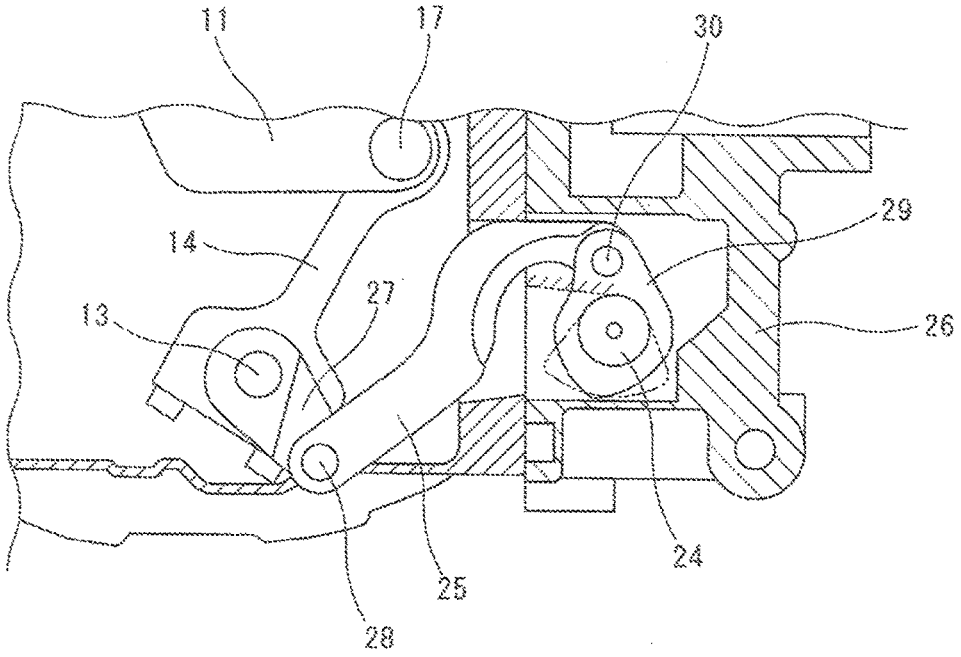
FIG. 2 is a sectional view showing a portion near a link mechanism.

As shown in FIG. 1 and FIG. 2, a link mechanism 22 is disposed in a power transmitting path between an output shaft of an actuator 20 such as a motor arranged to drive and rotate the first control shaft 13, and the first control shaft 13. The link mechanism 22 is arranged to decrease a speed of a power of a rotation of the output shaft of the motor, and to transmit this to the first control shaft 13. This link mechanism 22 includes a speed reducer such as a wave gear device arranged to obtain a large speed reduction. This link mechanism 22 includes a second control shaft 24 arranged to rotate as a unit with an output shaft of this speed reducer, and a lever 25 connecting this second control shaft 24 and the first control shaft 13 (cf. FIG. 1). The second control shaft 24 is received within a housing 26 which is fixed on a side surface of the cylinder block 2. The second control shaft 24 is rotatably supported by the housing 26 in a posture in which the second control shaft 24 is parallel to the first control shaft 13. The lever 25 penetrates through and extends through slits of the cylinder block 2 and the housing 26.

One end of the lever 25 and a tip end of the first arm portion 27 which extends in the radial direction from the journal portion 13A of the first control shaft 13 are connected through a first link pin 28 to be rotated relative to each other. The other end of the lever 25 and a tip end of a second arm portion 29 which extends in the radial direction from a journal portion 24A that is a rotation center of the second control shaft 24 are connected through a second link pin 30 to be rotated relative to each other.

The first arm portion 27 has a length longer than that of the second arm portion 29 so as to reduce the speed of the rotation of the second control shaft 24, and to transmit this to the first control shaft 13.

In the thus-constructed variable compression ratio mechanism 10, when the rotation position of the first control shaft 13 is varied through the link mechanism 22 by the motor, a posture of the lower link 11 is varied through the control link 14. The stroke characteristics of the piston 5 which includes a piston upper dead center and a piston lower dead center are varied, so that the engine compression ratio is continuously varied.

Next, the configuration, operations, and effects in this embodiment are described.

[1] There are provided the variable compression ratio mechanism 10 arranged to vary the engine compression ratio in accordance with the rotation position of the first control shaft 13; the actuator 20 arranged to vary and hold the rotation position of the first control shaft 13; and the link mechanism 22 connecting the actuator 20 and the first control shaft 13.

This link mechanism 22 includes the second control shaft 24 disposed in parallel with the first control shaft 13, and the lever 25 connecting the first control shaft 13 and the second control shaft 24. The combustion load acted to the first control shaft 13 is transmitted through the lever 25 to the second control shaft 24.

Moreover, there are provided the first arm portion 27 extending in the radially outward direction from the first control shaft 13; the first link pin 28 which is inserted through the tip end of the first arm portion 27 and the one end portion of the lever 25, and which connects the first arm portion 27 and the lever 25 so that the first arm portion 27 and the lever 25 are rotated relative to each other; the second arm portion 29 extending from the second control shaft 24 in the radially outward direction; and the second link pin 30 which is inserted through the tip end of the second arm portion 29 and the other end of the lever 25, and which connects the second arm portion 29 and the lever 25 so that the second arm portion 29 and the lever 25 are rotated relative to each other. A diameter D1 of the first link pin 28 is greater than a diameter D2 of the second link pin 30.

The first control shaft 13 receives the load in an axis inclining direction (axially inclined direction) which is inclined with respect to the axial direction by the inertia load and the combustion load that are acted from the piston 5's side of the internal combustion engine. Accordingly, the bending/torsional vibration is easy to be generated. Consequently, in the first link pin 28 and the second link pin 30, the surface pressure of the bearing portion of the first link pin 28 directly connected to the first control shaft 13 is not constant due to the above-described load in the axis inclining direction. In the first link pin 28, the surface pressures at the both end portions in the axial direction are locally increased, so that the partial contact is easy to be generated.

On the other hand, the combustion load and the inertia load which are acted to the first control shaft 13 are indirectly transmitted to the second link pin 30 through the first link pin 28 and the lever 25. The transmission of the load in the axis inclining direction is decreased by the clearance and so on which is provided at the link portion and the bearing portion of these first link pin 28 and lever 25. The local increase of the surface pressure at the both end portions in the axial direction are suppressed and relieved relative to the first link pin 28's side. Therefore, in a case where the identical load is acted to the first link pin 28 and the second link pin 30, the surface pressure is locally increased in the first link pin 28 so that the first link pin 28 is easy to be abraded.

Therefore, in the first link pin 28 and the second link pin 30, the diameter D1 of the first link pin 28 is set to the relatively large value. With this, it is possible to suppress the local increase of the surface pressure and the partial contact of the first link pin 28, and to suppress the progression of the abrasion. On the other hand, the motion trajectory (locus) of the link portion including the second link pin 30 is decreased by relatively decreasing the diameter D2 of the second link pin 30. Accordingly, it is possible to improve the mountability of the engine, specifically to decrease the size and the weight of the housing 26 receiving this second link pin 30.

Figure 3:
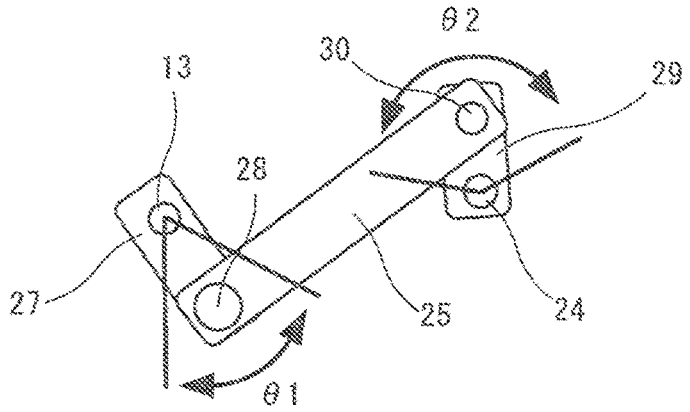
FIG. 3 is an illustrative view showing link portions of a lever, a first arm portion, and a second arm portion.

Moreover, in the first link pin 28 and the second link pin 30, the relative sliding speeds of the link pins with respect to the pin bearing portions at the variation of the compression ratio are small. Accordingly, the oil film is difficult to be produced on the bearing portion. Therefore, it is preferable to increase the pin sliding speed for improving the production of the oil film. In this case, in a configuration where the speed of the rotation is reduced, and where the speed-reduced rotation is transmitted from the second control shaft 24 to the first control shaft 13 as shown in FIG. 3, the operation angle θ2 of the second control shaft 24 (the relative rotation angle of the link pin with respect to the pin bearing portion) is greater than the operation angle θ1 of the first control shaft 13 (the relative rotation angle of the link pin with respect to the pin bearing portion). Accordingly, as to a circumferential rotation speed of the link pin with respect to the pin bearing per a predetermined variation amount of the compression ratio, that of the second link pin 30 is greater than that of the first link pin 28 in a case where the first link pin 28 and the second link pin 30 have the identical diameter. Therefore, the diameter D1 of the first link pin 28 on which the oil film is relatively difficult to be produced at the bearing portion is set to be greater than the diameter D2 of the second link pin 30, so as to form the good oil film on the first link pin 28 and the second link pin 30.

With this, it is possible to improve the lubrication performances, and to suppress the generation of the abrasion and the seizing.

Figure 4A:
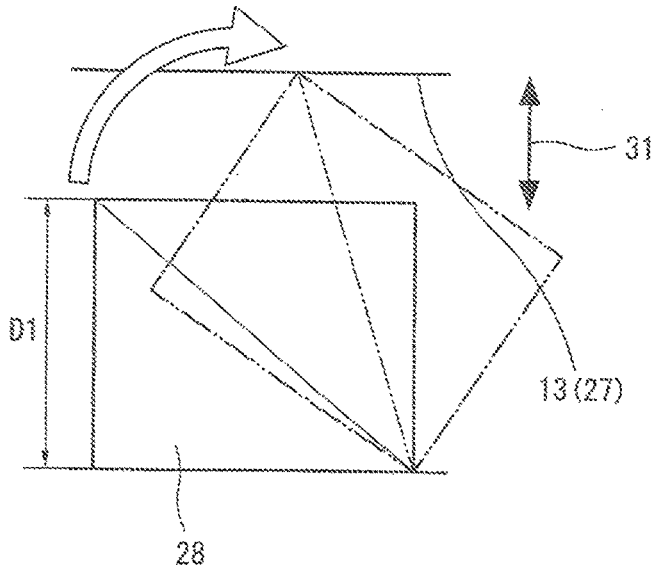
FIG. 4(A) is an illustrative view exaggeratingly showing an inclination deformation of a first link pin.
Figure 4B:
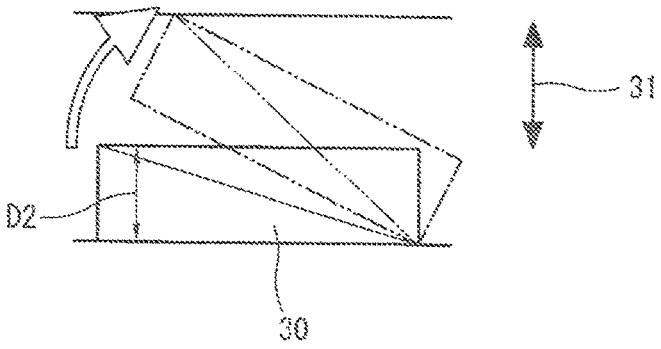
FIG. 4(B) is an illustrative view exaggeratingly showing an inclination deformation of a second link pin.

Moreover, the diameter D1 of the first link pin 28 is set to be relatively greater as shown in FIG. 4. With this, when the axial lengths of the first link pin 28 and the second link pin 30 are identical to each other, a ratio of the length/the diameter of the first link pin 28 becomes smaller than a ratio of the length/the diameter of the second link pin 30. With this, when the clearances 31 of the bearing portions are identical to each other, the freedom of the inclination angle within the bearing clearance 31 of the first link pin 28 connected to (the first arm portion 27 of) the first control shaft 13 in which the bending/torsional vibration in the axis inclining direction is greater due to the combustion load and so on from the piston's side is increased. Accordingly, it is possible to absorb the vibration and the inclination of the first control shaft 13 by the clearance 31 of the bearing portion of the first link pin 28, and the oil film of that bearing surface, and thereby to suppress the transmission of the vibration and the inclination to the lever 25's side. Consequently, it is possible to suppress the deterioration of the noise vibration due to the vibration of the lever 25, and to avoid the abnormal abrasion of the bearing portions of the second link pin 30 and the second control shaft 24.

[2] A sliding area of the first link pin 28 (an area of the bearing portion in which the first link pin 28, the first arm portion 27 and the lever 25 are rotated relative to one another) is set to be greater than a sliding area of the second link pin 30 (an area of the bearing portion in which the second link pin 30, the second arm portion 29 and the lever 25 are rotated relative to one another). By setting the sliding area of the first link pin 28 to be relatively greater in this way, it is possible to suppress the local increase of the surface pressure and the partial contact of the first link pin 28. On the other hand, in the second link pin 30, the transmission of the vibration of the eccentric shaft to the second link pin 30 is decreased by the bearing clearance 31 between the first link pin 28 and the lever 25. Accordingly, that surface pressure of the second link pin 30 is lower than that of the first link pin 28's side. Consequently, it is possible to decrease the sliding area of the second link pin 30 without causing the extreme increase of the surface pressure.

[3] An average surface pressure of the first link pin 28 is set to be smaller than an average surface pressure of the second link pin 30.

In the first link pin 28, the vibration, torsion, and bending deformation are easy to be generated due to the load from the piston 5's side through the first control shaft 13. Accordingly, the sliding condition is strict. Consequently, the diameter of the first link pin 28 is increased so as to suppress the average surface pressure. With this, it is possible to suppress the abrasion of the first link pin 28 which is easy to be worn away. On the other hand, the second link pin 30 is connected through the lever 25 to the first control shaft 13's side. Accordingly, it is possible to relieve the large vibration, torsion, and bending deformation of the piston 5's side, and to decrease the load, relative to the first link pin 28's side. Consequently, it is possible to suppress the progression of the abrasion even when the average surface pressure is relatively large on the second link pin 30's side.

[4] A surface roughness of the first link pin 28 is set to be smaller than a surface roughness of the second link pin 30. In this way, the surface roughness of the first link pin 28 on which the local surface pressure is large, and which is easy to be largely worn away is set to be smaller value. With this, it is possible to suppress the abrasion. On the other hand, the surface roughness of the second link pin 30's side on which the abrasion is relatively difficult to be progressed is relatively large. With this, it is possible to simplify the surface processing.

[5] A surface hardness of the first link pin 28 is set to be larger than a surface hardness of the second link pin 30. In this way, the surface hardness of the first link pin 28 in which the local surface pressure is large, and which is easy to be largely worn away is set to be large. With this, it is possible to suppress that abrasion.

[6] An effective bearing length of the first link pin 28 is set to be shorter than an effective bearing length of the second link pin 30.

That is, the diameter of the first link pin 28 is set to be larger than the diameter of the second link pin 30, as described above. Accordingly, it is possible to decrease the effective bearing length of the first link pin 28 without causing the deterioration of the surface pressure. With this, it is possible to suppress the entire length of the first link pin 28, and to improve the engine mountability, in particular, in the multiple cylinder internal combustion engine.

Figure 5:
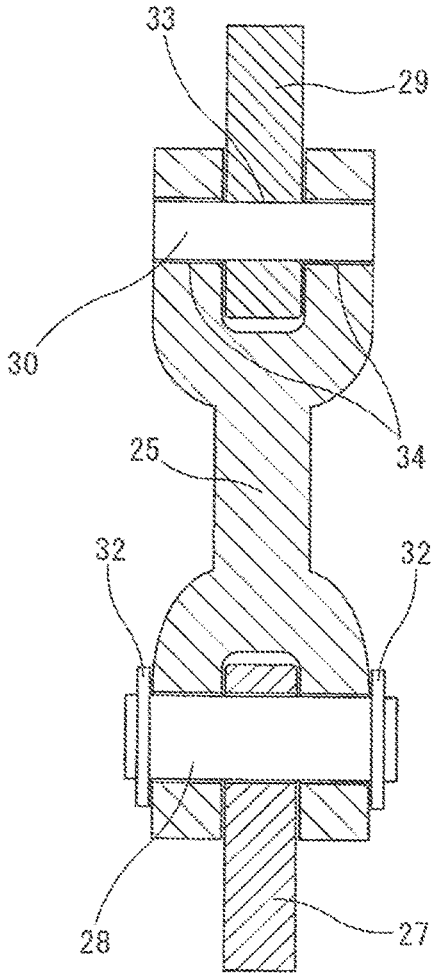
FIG. 5 is a sectional view showing a connection structure of the first link pin and the second link pin.

[7] As shown in FIG. 5, the first link pin 28 is arranged to be rotated relative to the first arm portion 27 and the lever 25. At the both ends, snap rings 32 which are pin drop preventing mechanisms are fixed. On the other hand, the second link pin 30 is fixed to one of the second arm portion 29 and the lever 25 (in this example, the second arm portion 29) so as not to be rotated relative to each other.

In this way, the first link pin 28 in which the vibration is relatively larger is fully-floated. With this, it is possible to decrease the vibration input transmitted to the second link pin 30's side. Consequently, even when the second link pin 30 is fixed to one of the second arm portion 29 and the lever 25 by the press-fit and so on so as not to be rotated, it is possible to suppress the deterioration of the vibration input to the actuator's side.

Moreover, in this way, the second link pin 30 is fixed to one of the second arm portion 29 and the lever 25 by the press-fit and so on. With this, it is possible to decrease the bearing width on the press-fit side (in this example, the second arm portion 29). Accordingly, it is possible to increase the bearing width of the other of the second arm portion 29 and the lever 25 (in this example, the lever 25) which is not fixed. Consequently, even when the diameter of the second link pin 30 is set to be relatively smaller, it is possible to suppress the deterioration of the surface pressure.

[8] Specifically, as shown in FIG. 5, the second link pin 30 is fixed to the second arm portion 29 by the press-fit. Moreover, the bearing portion 33 of the second arm portion 29 with respect to the second link pin 30 is sandwiched from the both sides by a pair of the bearing portions 34 of the lever 25 with respect to the second link pin 30.

By this structure, it is possible to suppress the inclination deformation of the lever 25 in the axis inclining direction, and to reduce the clearance of the bearing portion. Furthermore, the second link pin 30 is fixed to the second arm portion 29 by the press-fit. Accordingly, the drop of the second link pin 30 is prevented. The snap ring and so on for preventing the drop of the second link pin 30 is unnecessary. Moreover, the second link pin 30 and the second arm portion 29 are fixed by the press-fit at one axially central portion. Accordingly, it is possible to decrease the variation of the torque at the press-fit failure (release) at the press-fit operation, relative to a case where they are fixed by the press-fit at the two both portions in the axial direction.

[9] A sum of the axial widths of the pair of the bearing portions 34 of the second link pin 30 and the lever 25 is greater than the axial width of the bearing portion 33 of the second link pin 30 and the second arm portion 29.

In this way, the axial width of the pair of the bearing portions 34 of the second link pin 30 and the lever 25 which are relatively rotated is largely ensured. With this, it is possible to decrease the surface pressure of the sliding portions.

The invention claimed is:

1. A variable compression ratio internal combustion engine comprising:

a variable compression ratio mechanism arranged to vary an engine compression ratio in accordance with a rotation position of a first control shaft;

an actuator arranged to vary and hold the rotation position of the first control shaft; and a link mechanism arranged to connect the actuator and the first control shaft, the link mechanism including;

a second control shaft disposed in parallel with the first control shaft, a lever connecting the first control shaft and the second control shaft, a combustion load acted to the first control shaft being transmitted through the lever to the second control shaft, a first arm portion extending from the first control shaft in a radially outward direction, a first link pin which is inserted through a tip end of the first arm portion and one end of the lever, and which connects the first arm portion and the lever so that the first arm portion and the lever are rotated relative to each other, a second arm portion extending from the second control shaft in the radially outward direction, and a second link pin which is inserted through a tip end of the second arm portion and the other end of the lever, and which connects the second arm portion and the lever so that the second arm portion and the lever are rotated relative to each other, the first link pin having a diameter larger than a diameter of the second link pin.

2. The variable compression ratio internal combustion engine as claimed in claim 1, wherein a sliding area of the first link pin is larger than a sliding area of the second link pin.

3. The variable compression ratio internal combustion engine as claimed in claim 1, wherein an average surface pressure of the first link pin is smaller than an average surface pressure of the second link pin.

4. The variable compression ratio internal combustion engine as claimed in claim 1, wherein a surface roughness of the first link pin is smaller than a surface roughness of the second link pin.

5. The variable compression ratio internal combustion engine as claimed in claim 1, wherein a surface hardness of the first link pin is higher than a surface hardness of the second link pin.

6. The variable compression ratio internal combustion engine as claimed in claim 1, wherein an effective bearing length of the first link pin is shorter than an effective bearing length of the second link pin.

7. The variable compression ratio internal combustion engine as claimed in claim 1, wherein the first link pin is arranged to be rotated relative to the first arm portion and the lever; and the second link pin is fixed to one of the second arm portion and the lever so as not to be rotated relative to each other.

8. The variable compression ratio internal combustion engine as claimed in claim 7, wherein the second link pin is fixed to the second arm portion by press-fit; a bearing portion of the second arm portion with respect to the second link pin is sandwiched from both sides by a pair of bearing portions of the lever with respect to the second link pin.

9. The variable compression ratio internal combustion engine as claimed in claim 8, wherein a sum of axial widths of the pair of the bearing portions of the second link pin and the lever is greater than an axial width of a bearing portion of the second link pin and the second arm portion.

* * * * *